US007789239B2

(12) United States Patent
Juliano

(10) Patent No.: US 7,789,239 B2
(45) Date of Patent: Sep. 7, 2010

(54) INSERT TRAYS FOR PACKAGES, PACKAGES INCLUDING SUCH TRAYS, AND METHODS FOR PACKAGING ARTICLES OF MANUFACTURE

(76) Inventor: Don Juliano, 1152 Princeton Ave., Salt Lake City, UT (US) 84105

( * ) Notice: Subject to any disclaimer, the term of this patent is extended or adjusted under 35 U.S.C. 154(b) by 152 days.

(21) Appl. No.: 11/636,772

(22) Filed: Dec. 11, 2006

(65) Prior Publication Data

US 2008/0135445 A1 Jun. 12, 2008

(51) Int. Cl.
*B65D 1/36* (2006.01)
*B65D 6/04* (2006.01)
*B65D 81/02* (2006.01)

(52) U.S. Cl. ..... 206/564; 206/585; 206/586; 206/589; 206/592

(58) Field of Classification Search ..... 206/433, 206/557, 564, 585, 586, 589, 592; 229/407
See application file for complete search history.

(56) References Cited

U.S. PATENT DOCUMENTS 2,886,828 A * 5/1959 Lattuca ..... 4/494
4,113,095 A * 9/1978 Dietz et al. ..... 206/508
4,114,761 A * 9/1978 Kleiner ..... 206/591
5,144,897 A 9/1992 Avery
5,259,508 A 11/1993 Beckerman
5,335,770 A 8/1994 Baker et al.
5,366,080 A 11/1994 Carstersen et al.
5,377,862 A * 1/1995 Oakes et al. ..... 220/513
5,769,235 A 6/1998 Keach et al.
6,123,200 A * 9/2000 Stephens et al. ..... 206/592
6,298,989 B1 * 10/2001 Chu ..... 206/320
6,325,210 B1 * 12/2001 Henry, Jr. ..... 206/427
6,500,369 B1 * 12/2002 Gorowicz et al. ..... 264/46.5
6,786,334 B2 9/2004 Smith
6,805,241 B2 10/2004 Smith
6,820,743 B2 11/2004 Hurley et al.
6,948,293 B1 9/2005 Eckermann et al.
7,093,717 B2 * 8/2006 Sakai et al. ..... 206/591
2002/0195371 A1 * 12/2002 Brown ..... 206/564
2003/0146128 A1 * 8/2003 Sakai et al. ..... 206/583
2006/0137073 A1 * 6/2006 Crisco ..... 2/142

OTHER PUBLICATIONS

PCT International Search Report for Application No. PCT/US07/25363 dated Oct. 6, 2008.

* cited by examiner

*Primary Examiner*—Mickey Yu
*Assistant Examiner*—Sharon M Prange
(74) *Attorney, Agent, or Firm*—Traskbritt

(57) ABSTRACT

Trays for securing an article of manufacture within a container include a recess for receiving at least a portion of the article of manufacture therein. The trays also may include one or more sidewalls extending from an edge of the tray towards a container-bearing surface of the tray. At least a portion of the sidewalls may comprise a plurality of generally curved regions defining a plurality of steps leading from the edge of the tray towards the container-bearing surface of the tray. Methods of packaging an article of manufacture include providing such a tray into a container, causing a surface of the tray to abut against a corner or edge of the container, and inserting the article of manufacture into the recess in the tray. Packages for shipping and/or storing such articles of manufacture may include one or more of such trays disposed within a container.

26 Claims, 5 Drawing Sheets

INSERT TRAYS FOR PACKAGES, PACKAGES INCLUDING SUCH TRAYS, AND METHODS FOR PACKAGING ARTICLES OF MANUFACTURE

FIELD OF THE INVENTION

The present invention relates to packaging articles of manufacture for storage and/or shipment. More particularly, the present invention relates to insert trays that can be provided within an outer container and used to secure and protect an article of manufacture therein against damage, to packages including one or more such trays, and to methods of packaging an article of manufacture using one or more such trays.

BACKGROUND OF THE INVENTION

During shipment, packages are often subjected to significant impact forces and vibrations. Various containers and methods for protectively packaging fragile articles of manufacture (such as, for example, glassware (e.g., bottles), electronic devices, etc.) have been presented in the art.

For example, it is known in the art to provide an article of manufacture in a container, such as a cardboard box, and to fill the voids or spaces within the container around the article of manufacture with loose particulate material. Such loose particulate material may include, for example, particles of expanded polystyrene or another polymer material, which are often referred to in the art as "loosefill peanuts." Cardboard inserts also may be used within the container to minimize or prevent migration (e.g., settlement) of the loose particulate material during shipment. For example, corrugated cardboard inserts may be provided between articles of manufacture within a container prior to filling the container with loose particulate material.

It is also known in the art to wrap articles of manufacture in plastic sheeting comprising encapsulated pockets of air, which is often referred to in the art as "bubble-pack," prior to positioning the articles of manufacture within a container for shipment. The encapsulated pockets of air in the plastic sheeting provide a cushion that protects the article of manufacture wrapped in the plastic sheeting against impact shock and vibrations. It is also known to wrap an article of manufacture in the previously described plastic sheeting comprising encapsulated pockets of air, insert the wrapped article of manufacture in a container, and then fill any voids or spaces within the container around the article of manufacture with the previously described loose particulate material.

Additional containers and methods for packing articles of manufacture for shipment are described in the prior art, a few of which are briefly described below.

U.S. Pat. No. 5,144,897 to Avery describes a shipping package for barrels. A tray having a plurality of raised abutments projecting from its interior surface is attached to a pallet. The raised abutments are configured to engage the vertical outside surfaces of the barrels, thereby maintaining the barrels in a substantially fixed position relative to the pallet. An extra tray may be inverted and used as a cap over the top of the barrels positioned in the first tray to further protect the barrels.

U.S. Pat. No. 5,259,508 to Beckerman describes a shock absorbent cap that can be used within a container for shipping a product. The shock absorbent cap has a base and a plurality of product positioning structures that arise out of and around the edges of the base and define a product cavity. The shock absorbent cap also includes a plurality of resilient spring walls that are connected to the product positioning structures and extend downwardly and outwardly therefrom. The spring walls connect each other at the corners. To ship a product, the product is placed in the product cavity of the cap, and the cap is placed in a rigid container.

U.S. Pat. No. 5,366,080 to Carstersen et al. describes molded holding members that can be used to ship disc drives. The holding members have a plurality of receptacles recessed in a face of each holding member for fixably maintaining and protecting a plurality of disc drives in a container. The holding members each have four sides with a centrally located T-shaped cushion pad having smooth sides for conforming to the interior of the container. The union of each side is formed by a pair of inverted L-shaped cushion pads joined at the top and whose junction is chamfered for ease of insertion and removal from the container. The holding members each have an end that includes a plurality of tapered conical cushion pads for providing shock protection for the disc drive devices enclosed within the holding members.

U.S. Pat. No. 6,786,334 to Smith discloses a product cushioning structure for supporting a product and co-packaged accessories in an outer container. The product cushioning structure is formed of a moldable resilient plastic material and provides shock absorption protection and impact protection to the product from the co-packaged accessories during shock loading conditions. A product-supporting region of the cushioning structure is defined by walls and a product-supporting platform. The product-supporting region is surrounded by flexible shock-absorbing spring transition sections arranged inwardly of outer container contacting walls. A void is formed beneath the platform, which is ribbed to further protect the product from impact or contact from any co-packaged accessory.

U.S. Pat. No. 6,805,241 to Smith discloses a protective packaging device for a product being shipped or stored in an outer container. The packaging device has a cavity for receiving the product therein. A base portion located below the cavity has two pairs of deflection elements extending diagonally away from the corners of the cavity towards external outer packaging container contacting corners. The base portion also includes outer packaging container contacting lips at the bottom of the base portion. The distances between adjacent pairs of outer packaging container contacting corners are substantially equal to the internal distances between adjacent pairs of corners of the outer packaging container. The deflection elements are adapted to flex away one from another under shock loading conditions. The bottom outer packaging container contacting lips are adapted to spread away from one another under shock loading conditions.

U.S. Pat. No. 6,820,743 to Hurley et al. discloses a shipping tray for bottles or the like. The shipping tray includes bottle receiving cradles and has top and bottom stop members to prevent the bottle from sliding out of the tray. Shock-absorbing members are provided about the perimeter of the tray. Indentations are provided at spaced locations on the tray perimeter and function as shock-absorbing spring members. The indentations further can be used as grips to enable easy removal of the tray from within a container.

BRIEF SUMMARY OF THE INVENTION

In one embodiment, the present invention includes a tray for at least partially securing an article of manufacture within a container. The tray includes at least one recess defined in an article-supporting wall member that is configured to receive at least a portion of an article of manufacture therein. The tray may also include at least one sidewall that extends from an edge of the tray generally towards a container-bearing surface of the tray. At least a portion of the sidewall may comprises a plurality of generally curved regions defining a plurality of steps leading from the edge of the tray towards the container-bearing surface of the tray.

In another embodiment, the present invention includes a package for containing at least one article of manufacture therein. The package includes an outer container and at least one inner tray disposed within the outer container. The tray includes at least one recess defined in an article-supporting wall member that is configured to receive at least a portion of an article of manufacture therein. The tray may also include at least one sidewall that extends from an edge of the tray generally towards a container-bearing surface of the tray. At least a portion of the sidewall may comprise a plurality of generally curved regions defining a plurality of steps leading from the edge of the tray towards the container-bearing surface of the tray.

In yet another embodiment, the present invention includes a method of packaging an article of manufacture. The method includes providing a tray comprising at least one sidewall extending from an edge of the tray towards a container-bearing surface of the tray and comprising a plurality of generally curved regions, which may define a plurality of steps leading from the edge of the tray towards the container-bearing surface of the tray. The tray is inserted into an outer container and the container-bearing surface of the tray is caused to abut against an interior edge or corner of the container. At least a portion of the article of manufacture may be inserted into at least one recess defined by at least a portion of the article-supporting wall member of the tray.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

The illustrations presented herein should not be interpreted in a limiting sense as actual views of any particular apparatus or system, but are merely idealized representations which are employed to describe the present invention. Additionally, elements common between figures may retain the same numerical designation.

Figure 1:
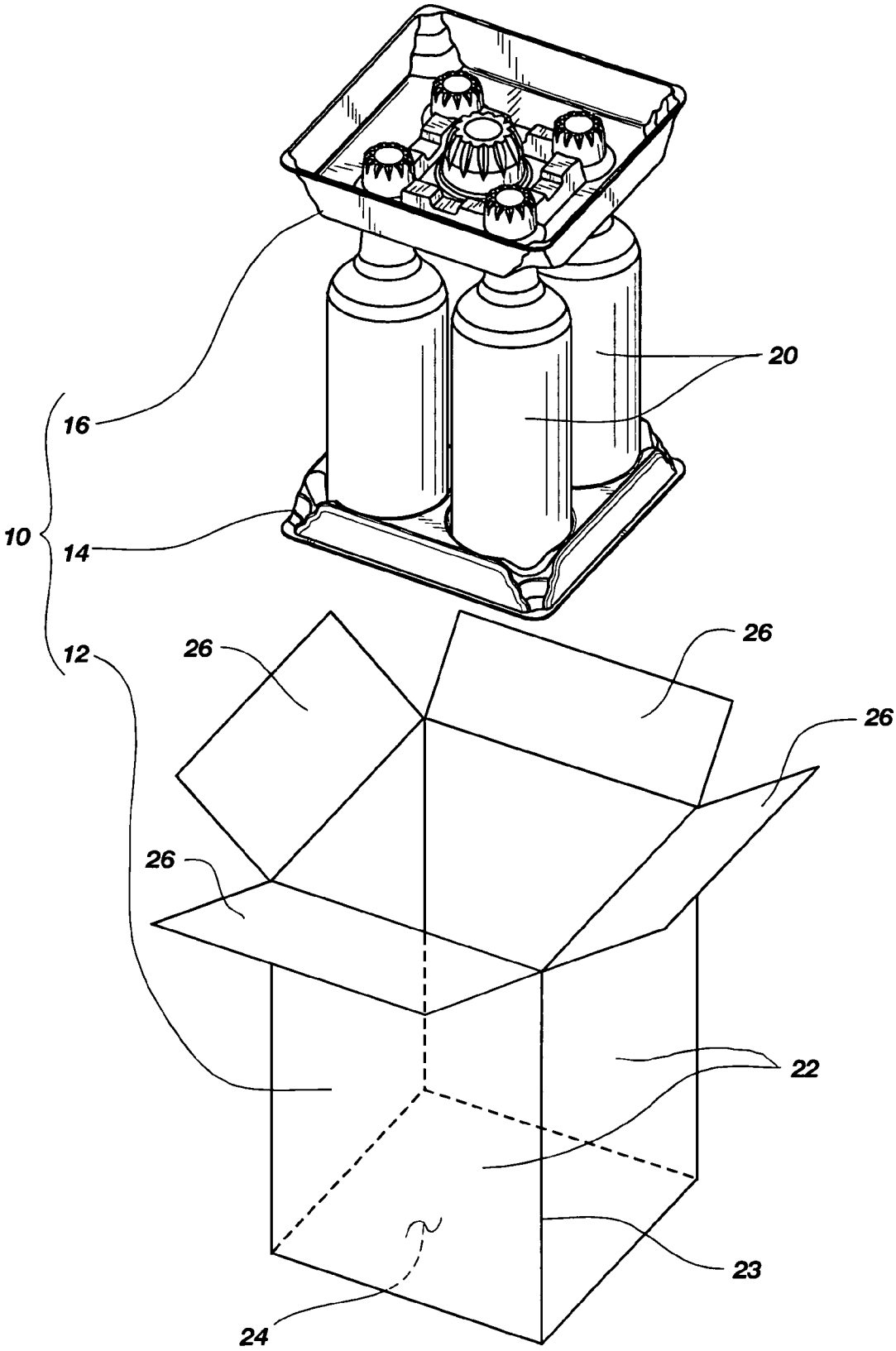
FIG. 1 is a partially exploded view of one example of a package that embodies teachings of the present invention.

A package 10 providing one example of a package that embodies teachings of the present invention is shown in a partially exploded view in FIG. 1. As shown in FIG. 1, the package 10 may include an outer container 12, a first inner tray 14, and a second inner tray 16. In additional embodiments of the present invention, the package 10 may include only one inner tray or more than two inner trays.

By way of example only and not limitation, the package 10 is shown in FIG. 1 configured for carrying four (4) bottles 20, such as typical wine or other beverage bottles. Packages that embody teachings of the present invention, however, are not limited to packages configured to carry bottles and may be configured to carry any article of manufacture. Furthermore, packages that embody teachings of the present invention may be configured to carry any number (one or more) of articles of manufacture therein. For example, in additional embodiments, the package 10 may be configured to carry one (1), two (2), three (3), or more than four (4) bottles therein.

The outer container 12, bottles 20, first inner tray 14, and a second inner tray 16 of the package 10 may be configured such that the bottles 20 are substantially equally spaced from one another within the package 10, and such that a center of mass of the package is substantially laterally centered along a vertical axis within the package 10.

As shown in FIG. 1, the outer container 12 of the package 10 may include, for example, a corrugated cardboard box. In some embodiments, the outer container 12 may have a box shape as shown in FIG. 1. In this embodiment, the container 12 includes four (4) lateral side panels 22 and two end panels 24. The two end panels 24 may each include (or be defined by) one or more (e.g., four) subpanels 26.

In additional embodiments, the outer container 12 may have any other shape. For example, the outer container 12 may have one (1) generally cylindrical lateral side panel and two end panels. As additional examples, the outer container 12 may have any polygonal shape, and may have two (2), three (3), five (5), six (6), or any number of lateral side panels and two end panels.

With continued reference to FIG. 1, the first inner tray 14 of the package 10 may be configured to receive a first side or end of the bottles 20 therein (e.g., the bottom end of the bottles 20), and the second inner tray 16 of the package 10 may be configured to receive a second side or end of the bottles 20 therein (e.g., the top end of the bottles 20). In this configuration, the first inner tray 14 may be positioned at the bottom or lower end (in FIG. 1) of the outer container 12 of the package 10. The lower ends or bottoms of the bottles 20 may be placed in or on the first inner tray 14, and the second outer tray 16 may be positioned on or over the upper ends or tops of the bottles 20. The outer container 12 of the package 10 then may be closed. In this configuration, the bottles 20 may be shipped and/or stored in the package 10.

The first inner tray 14 and the second inner tray 16 may be configured and used to protect the bottles 20 within the outer container 12 during shipment and/or storage of the package 10, as discussed in further detail below.

Figure 2:
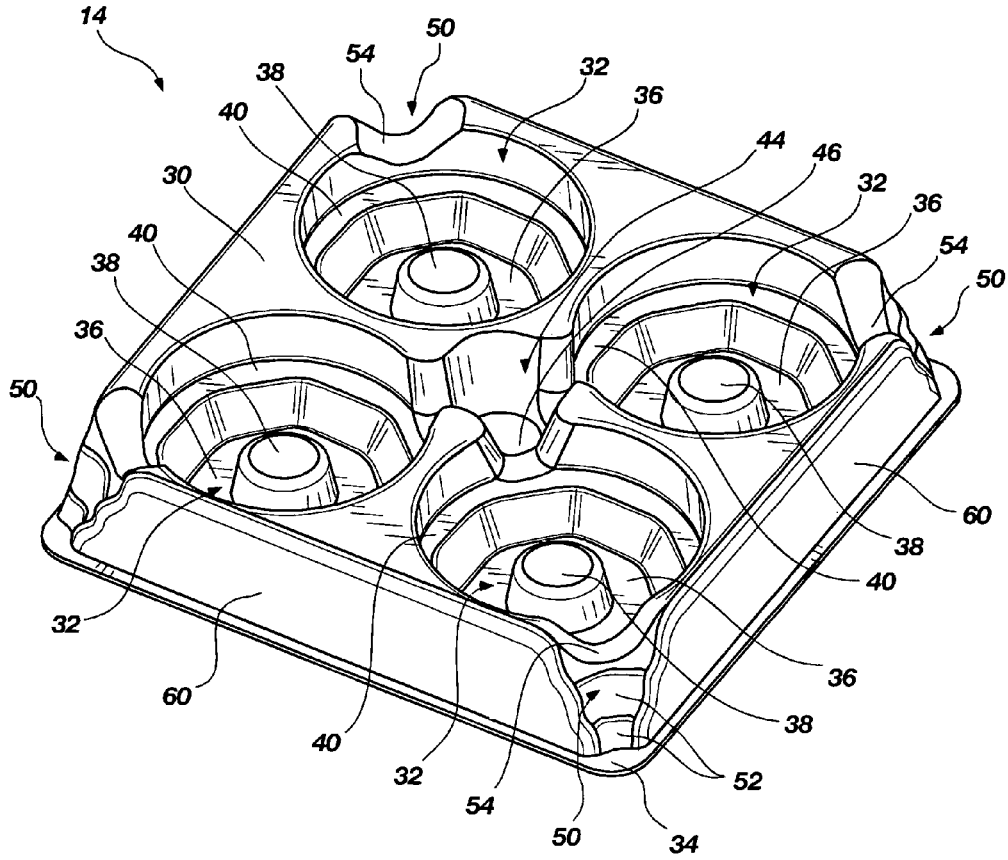
FIG. 2 is a perspective view of one example of an insert tray that embodies teachings of the present invention and that can be used in the package shown in FIG. 1.

An enlarged perspective view of the first inner tray 14 is shown in FIG. 2. The first inner tray 14 may include an article-supporting wall member 30. The first inner tray 14 also may include one or more recesses 32, each of which may be configured to receive at least a portion of the lower end or bottom of one bottle 20 therein. The recesses 32 each may be defined by a portion of the article-supporting wall member 30, and may conform to and confine at least the portion of the bottle 20 received therein. The first inner tray 14 also may include a flange member 34. The flange member 34 may be configured such that the lower surface of the flange member 34 abuts against the lower or bottom end panel 24 of the outer container 12 (FIG. 1) and the lateral side surface of the flange member 34 abuts against the lateral side panels 22 of the container 12 when the first inner tray 14 is positioned within the outer container 12.

Each of the recesses 32 of the first inner tray 14 may include a bottom panel 36. In some embodiments, at least a portion of the bottom panel 36 of each of the recesses 32 may be substantially coplanar with the flange member 34, and may be configured to abut against the lower end panel 24 of the outer container 12 when the first inner tray 14 is disposed within the outer container 12. At least one central platform member 38 may be provided in each of the recesses 32. The central platform members 38 may be configured to support the bottles 20 (FIG. 1) off from the bottom panel 36 within the recesses 32. One or more peripheral platform members 40 also may be provided in each of the recesses 32, and the peripheral platform members 40 also may be configured to support the bottles 20 (FIG. 1) away from the bottom panel 36 within the recesses 32. The central platform members 38 and the peripheral platform members 40 may enhance the ability of the first inner tray 14 to absorb shock or impact forces and protect the bottles 20 against damage.

In some embodiments, the first inner tray 14 also may include one or more container-bearing structures 44 defined by a portion of the article-supporting wall member 30. In the embodiment shown in FIG. 2, the first inner tray 14 includes one container-bearing structure 44 defined by a portion of the article-supporting wall member 30. Similar to the previously described recesses 32, the one or more container-bearing structures 44 also may include a bottom panel 46, at least a portion of which may be substantially coplanar with the flange member 34 and configured to abut against the lower end panel 24 of the outer container 12 when the first inner tray 14 is disposed within the outer container 12. The container-bearing structures 44 also may enhance the ability of the first inner tray 14 to absorb shock or impact forces and protect the bottles 20 against damage.

With continued reference to FIG. 2, the first inner tray 14 also may include four (4) energy-dispersive lateral sidewalls 50 configured to disperse energy through the first inner tray 14 when an impact force is applied to the flange member 34 (such as, for example, when the package 10 is dropped such that a corner or edge of the outer container 12 experiences the initial contact between the outer container 12 and the ground or other surface), which can protect the bottles 20 therein against damage. The first inner tray 14 also may include four (4) additional lateral sidewalls 60 that are generally planar. In this configuration, the first inner tray 14 may be generally rectangular. Each of the energy-dispersive lateral sidewalls 50 may be disposed proximate a corner of the rectangular first inner tray 14, and the generally planar additional lateral sidewalls 60 may be disposed along the major sides of the rectangular first inner tray 14. Each energy-dispersive lateral sidewall 50 may be coextensive with the two generally planar additional lateral sidewalls 60 adjacent thereto.

Each of the energy-dispersive lateral sidewalls 50 may have a relatively complex three-dimensional shape. For example, as can be seen with reference to FIG. 3, each of the energy-dispersive lateral sidewalls 50 may have a generally partial conical shape. In other words, each of the energy-dispersive lateral sidewalls 50 may have a shape similar to a portion of a cone. Furthermore, each of the energy-dispersive lateral sidewalls 50 may comprise a plurality of generally curved regions 52. The curved regions 52 may define a plurality of steps or stepped regions that lead from an edge 54 of the first inner tray 14 (which may be radiused or chamfered) generally towards a container-bearing surface of the first inner tray 14, such as a surface of the flange member 34. The edges 54 of the first inner tray 14 may be defined by the intersections between the article-supporting wall member 30 and each of the respective energy-dispersive lateral sidewalls 50.

Figure 3:
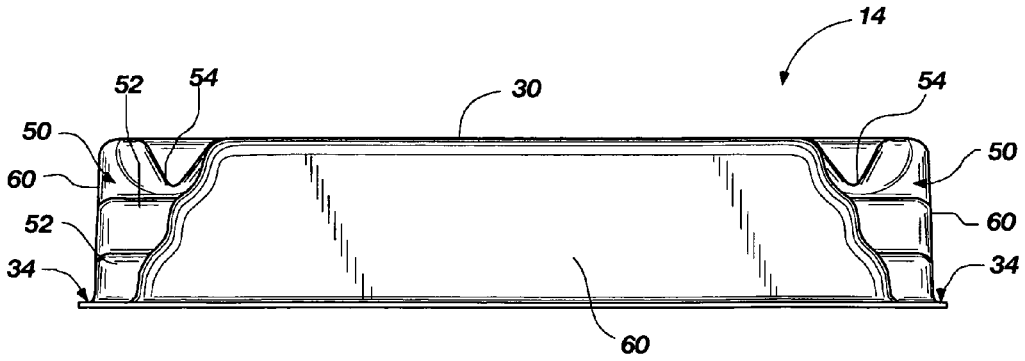
FIG. 3 is a size view of the insert tray shown in FIG. 2.

As shown in FIGS. 2 and 3, each of the generally curved regions 52 may extend in a generally lateral direction in a plane that is generally parallel to a plane in which the flange member 34 is disposed (e.g., in a plane that is generally parallel to a plane in which the end panels 24 of the outer container 12 (FIG. 1) are disposed).

As can be seen with reference to FIG. 3, in some embodiments of the present invention, at least a portion of the article-supporting wall member 30 (e.g., the uppermost surface of the article-supporting wall member 30) may be substantially planar, and the generally planar additional lateral sidewalls 60 may extend away from the article-supporting wall member 30 in a direction substantially perpendicular to that planar portion of the article-supporting wall member 30. The lateral sidewalls 60 may also extend away from the article supporting wall member in a direction substantially horizontal and away from the center of the inner tray 14.

Figure 4:
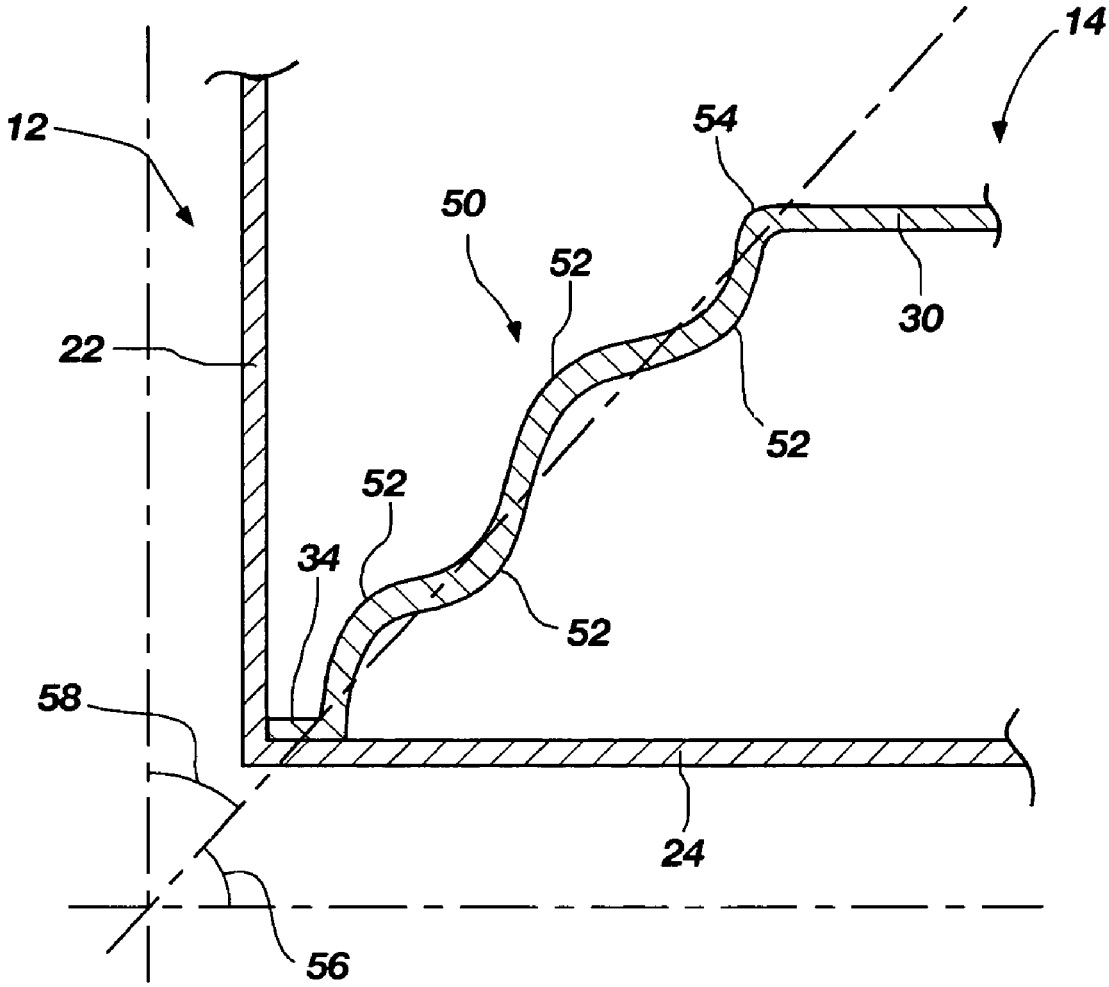
FIG. 4 is an enlarged partial cross-sectional view of a lower or bottom corner of the package shown in FIG. 1.

FIG. 4 is an enlarged partial cross-sectional view of a lower or bottom corner of the package 10 (FIG. 1) taken through a vertical plane-oriented diagonally through the package 10 and extending through an edge 23 defined by the intersection between two lateral side panels 22 of the outer container 12. A portion of an energy-dispersive lateral sidewall 50 of the first inner tray 14 is shown within the container 12 in FIG. 4.

As shown in FIG. 4, in some embodiments of the present invention, each of the energy-dispersive lateral sidewalls 50 may have a substantially uniform wall thickness. Furthermore, the generally curved regions 52 may comprise a plurality of substantially adjacent, alternating convex and concave sections, which may define a plurality of undulating steps, waves, ripples, etc. between the flange member 34 and the edge 54. For example, each of the generally curved regions 52 may have a cross-sectional shape that is arcuate. Furthermore, in some embodiments of the present invention, each of the generally curved regions may be free of sharp edges. In other words, each of the generally curved regions may have an average radius of curvature that is greater than about 2.54 millimeters (about 0.1 inch). In this configuration, at least a portion of each of the energy-dispersive lateral sidewalls 50 may have a generally sinusoidal cross-sectional shape. By eliminating or reducing the number of sharp edges in the energy-dispersive lateral sidewalls 50 and the other features of elements of the first inner tray 14 (as well as the subsequently described second inner tray 16), the ability of the package 10 to protect the bottles 20 from damage may be enhanced.

As also shown in FIG. 4, each of the energy-dispersive lateral sidewalls 50 may be generally oriented at an acute angle 56 relative to an end panel 24 of the outer container 12, and/or at an acute angle 58 relative to a lateral side panel 22 of the outer container 12 when the first inner tray 14 is disposed therein.

In the configuration described above, each of the energy-dispersive lateral sidewalls 50 may resist crushing and spread any shock or impact forces along the adjacent generally planar additional lateral sidewalls 60 when an impact force is applied to the outer container 12 at a location proximate the respective energy-dispersive lateral sidewalls 50, such as when the package 10 is dropped and a lower corner of the outer container 12 experiences initial contact with the ground or other surface.

Figure 5:
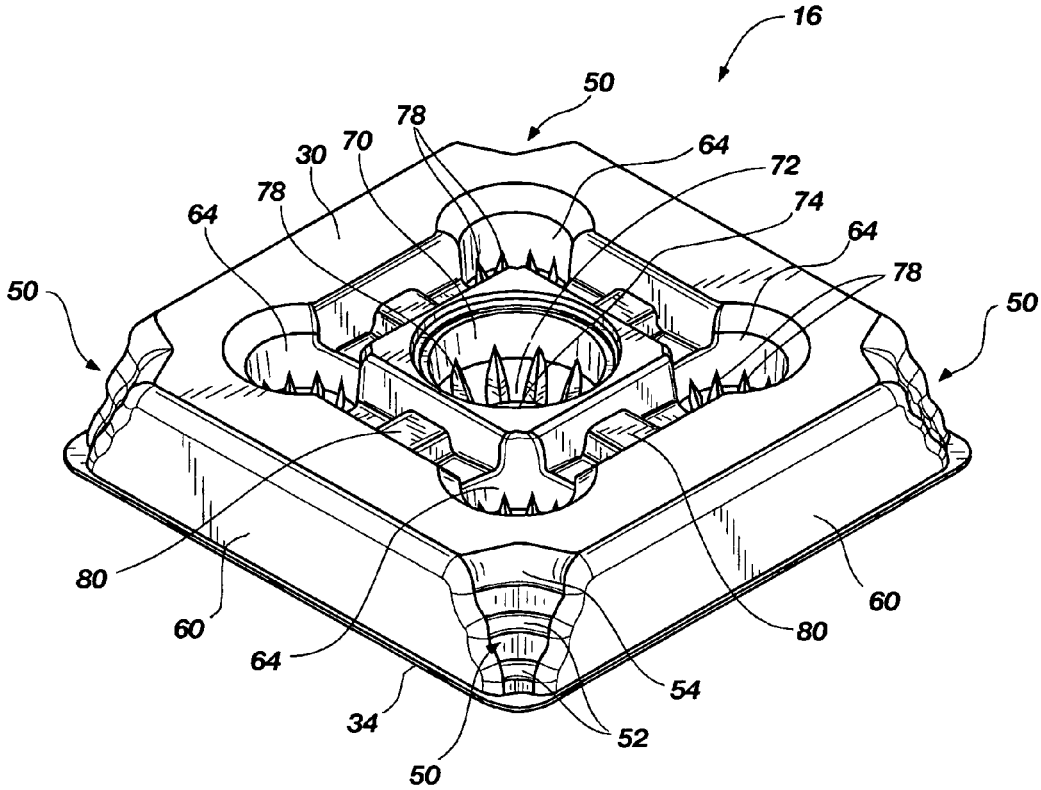
FIG. 5 is a perspective view of another insert tray that embodies teachings of the present invention and that can be used in the package shown in FIG. 1.

FIG. 5 is an enlarged perspective view of the second inner tray 16. The second inner tray 16 may be generally similar to the first inner tray 14, and may include an article-supporting wall member 30. The second inner tray 16 also may include one or more recesses 64, each of which may be configured to receive at least a portion of the upper end or top of one bottle 20 (FIG. 1) therein. The recesses 64 each may be defined by a portion of the article-supporting wall member 30 of the second inner tray 16, and may conform to and confine at least the portion of the bottle 20 received therein. Recesses 32 (FIG. 2) and recesses 64 (FIG. 5) may or may not be the same sizes and/or shapes. The second inner tray 16 also may include a flange member 34, which may be configured such that the lower surface of the flange member 34 (i.e., lower from the perspective of FIG. 5) abuts against the upper or top end panel 24 of the outer container 12 (FIG. 1) and the lateral side surface of the flange member 34 abuts against the lateral side panels 22 of the container 12 when the second inner tray 16 is positioned over the bottles 20 within the outer container 12, as shown in FIG. 1.

Figure 6:
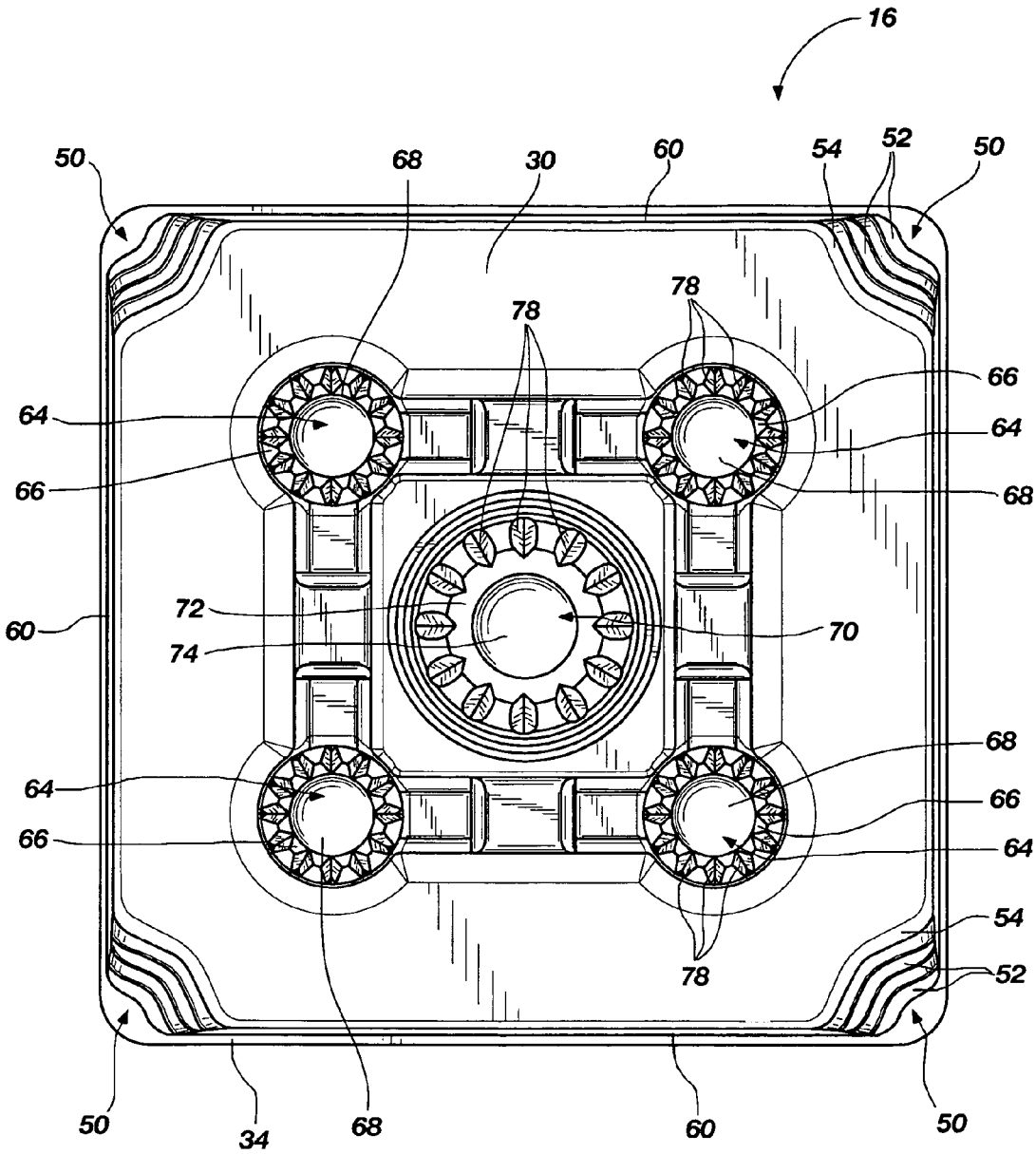
FIG. 6 is a plan view of the insert tray shown in FIG. 5.

FIG. 6 is a plan view of the second inner tray 16 shown in FIG. 5, illustrating the side of the second inner tray 16 configured to face the bottles 20 (FIG. 1) when the second inner tray 16 is disposed within the outer container 12. As shown in FIG. 6, each of the recesses 64 of the second inner tray 16 may include a bottom panel 66 (i.e., bottom from the perspective of FIG. 6). At least a portion of the bottom panel 66 of each of the recesses 64 may be substantially coplanar with the flange member 34 of the second inner tray 16, and may be configured to abut against the top end panel 24 of the outer container 12 when the second inner tray 16 is positioned within the outer container 12. One or more platform members 68 may be provided in each of the recesses 64. The platform members 68 may comprise, for example, convex domes or dimples configured to support the bottles 20 (FIG. 1) off from the bottom panel 66 within the recesses 64. The platform members 68 may enhance the ability of the second inner tray 16 to absorb shock or impact forces and protect the bottles 20 against damage.

The second inner tray 16 also may include at least one container-bearing structure 70. The at least one container-bearing structure 70 also may be defined by a portion of the article-supporting wall member 30 of the second inner tray 16, and may include a bottom panel 72. At least a portion of the bottom panel 72 of the container-bearing structure 70 may be substantially coplanar with the flange member 34 of the second inner tray 16, and may be configured to abut against the upper end panel 24 of the outer container 12 (FIG. 1) when the second inner tray 16 is disposed within the outer container 12. A convex dome or dimple 74 also may be provided in the bottom panel 72 of the container-bearing structure 70, as necessary or desired. The container-bearing structures 70 and the convex dome or dimples 74 also may enhance the ability of the second inner tray 16 to absorb shock or impact forces and protect the bottles 20 against damage.

As shown in FIGS. 5 and 6, vertically oriented rib members 78 may be provided in the sidewalls of the container-bearing structure 70. Such vertically oriented rib members 78 may provide added strength and rigidity to the container-bearing structure 70 so as to increase the ability of the container-bearing structure 70 to resist being crushed or to collapse due to an impact force applied to the top end panel 24 of the container 12 (FIG. 1). Vertically oriented rib members 78 also may be provided in the sidewalls of each of the recesses 64, as also shown in FIGS. 5 and 6. Although not shown in the figures, vertically oriented rib members 78 also may be provided in the sidewalls of the container-bearing structure 44 and/or the sidewalls of the recesses 32 of the first inner tray 14 shown in FIGS. 2 and 3.

As shown in FIGS. 5 and 6, the second inner tray 16 also may include four (4) energy-dispersive lateral sidewalls 50, like those previously described in relation to the first inner tray 14, each of which may be disposed or located proximate one of the four (4) corners of the generally rectangular second inner tray 16.

The second inner tray 16 also may include one or more laterally oriented rib members 80. For example, a laterally oriented rib member defined by a portion of the article-supporting wall member 30 of the second inner tray 16 may extend laterally between one or more of the recesses 64. Such laterally oriented rib members 80 may provide added rigidity to the second inner tray 16, which may enhance resistance to torsion and/or bending stresses, which may further enhance the ability of the second inner tray 16 to protect the bottles 20 (FIG. 1) against damage.

Figure 7:
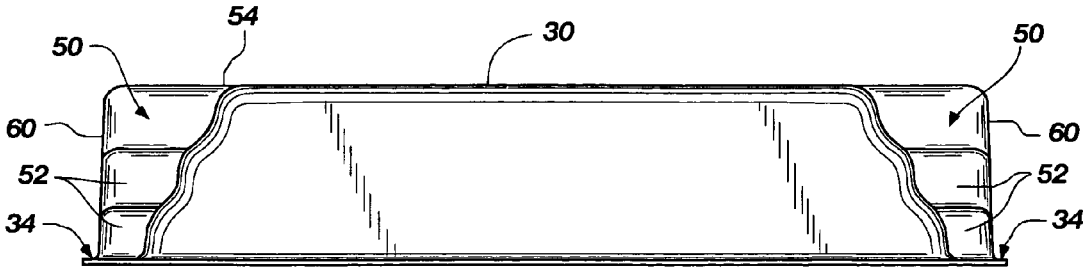
FIG. 7 is a side view of the insert tray shown in FIGS. 5 and 6.

FIG. 7 is a side view of the second inner tray 16 shown in FIGS. 5 and 6. As shown therein, in some embodiments of the present invention, at least a portion of the article-supporting wall member 30 (e.g., the uppermost surface of the article-supporting wall member 30) of the second inner tray 16 may be substantially planar, and the generally planar additional lateral sidewalls 60 of the second inner tray 16 may extend away from the article-supporting wall member 30 in a direction substantially perpendicular to that planar portion of the article-supporting wall member 30. The lateral sidewalls 60 may also extend away from the article supporting wall member in a direction substantially horizontal and away from the center of the inner tray 16.

Each of the first inner tray 14 and the second inner tray 16 of the package 10 may comprise a polymer material such as, for example, polyethylene, polyethylene terephthalate (PET), and polyurethane. Such trays 14, 16 may be formed using, for example, a molding process (e.g., injection molding, compression molding, transfer molding, etc.) or using a thermoforming process (e.g., beating above a glass transition temperature of the plastic material and stamping or pressing the sheet of material in a die or mold) to shape a generally planar sheet of polymer material into the form of the trays 14, 16. In additional embodiments, each of the first inner tray 14 and the second inner tray 16 of the package 10 may comprise a metal material. Such trays also may be formed using a forming or stamping operation to shape a sheet of metal material into the form of the trays 14, 16. Each of the first inner tray 14 and the second inner tray 16 of the package 10 may be substantially non-porous.

In additional embodiments, the first inner tray 14 and the second inner tray 16 may not be generally rectangular, as shown in the figures. For example, in additional embodiments, the first inner tray 14 and the second inner tray 16 each may be generally circular. In such embodiments, the article-supporting wall member 30 of both the first inner tray 14 and the second inner tray 16 may be generally circular. A single, substantially continuous energy-dispersive sidewall 50 may extend from the peripheral edge of the article-supporting wall member 30 of both of both the first inner tray 14 and the second inner tray 16. More particularly, the energy-dispersive sidewall 50 may extend from an edge defined by the intersection between the article-supporting wall member 30 and the energy-dispersive sidewall 50 towards an edge of a generally cylindrical outer container (e.g., a circular edge defined by the intersection between a generally cylindrical lateral side panel and a generally circular end panel). Such energy-dispersive lateral sidewalls 50 may comprise a plurality of generally curved regions 52, as previously described, and the curved regions 52 may define a plurality of steps or stepped regions that lead from the edge defined by the intersection between the article-supporting wall member 30 and the energy-dispersive sidewall 50 towards the outer container. Such a generally cylindrical package may be used, for example, to ship a single bottle or other article of manufacture therein.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A tray for at least partially securing an article of manufacture within a container, the tray comprising:

at least one article-supporting wall member;

at least one recess configured to receive at least a portion of an article of manufacture therein and defined by at least a portion of the at least one article-supporting wall member; and a plurality of planar sidewalls extending from an edge of the tray, the edge of the tray defined by an intersection between the at least one article-supporting wall member and the plurality of planar sidewalls, towards a container-bearing surface of the tray;

at least one energy dispersive corner disposed diagonally between two adjoining planar sidewalls, the at least one corner comprising a plurality of generally convex and concave regions having a generally sinusoidal cross-sectional shape and defining a plurality of steps leading from the edge of the tray towards the container-bearing surface of the tray.

2. The tray of claim 1, wherein the at least one sidewall has a substantially uniform wall thickness.

3. The tray of claim 1, wherein each of the generally convex and concave regions has an average radius of curvature greater than about 2.54 millimeters (about 0.1 inch).

4. The tray of claim 1, wherein the tray comprises a generally rectangular tray, and wherein the at least one sidewall comprises at least four sidewalls, each of the at least four sidewalls disposed proximate a respective corner of the generally rectangular tray.

5. The tray of claim 4, wherein each of the at least four sidewalls has a generally partial conical shape.

6. The tray of claim 1, wherein at least a portion of the at least one article-supporting wall member is generally planar.

7. The tray of claim 1, wherein the at least one sidewall extends from the edge of the tray towards a container-bearing surface on a generally planar container-bearing flange of the tray.

8. The tray of claim 6, wherein at least another portion of the at least one article-supporting wall member defines a container-bearing structure, at least a portion of the container-bearing structure being substantially coplanar with the generally planar container-bearing flange of the tray.

9. The tray of claim 8, wherein the container-bearing structure comprises a dimple substantially surrounded by the at least a portion of the container-bearing structure.

10. The tray of claim 1, wherein the tray comprises a substantially non-porous polymer material.

11. A package for containing at least one article of manufacture therein, the package comprising:

an outer container comprising at least one corner or edge defined by the intersection between at least two panels of the outer container; and at least one inner tray disposed within the outer container, the at least one inner tray comprising:

at least one article-supporting wall member;

at least one recess configured to receive at least a portion of an article of manufacture therein and defined by at least a portion of the at least one article-supporting wall member; and a plurality of planar sidewalls extending from an edge of the at least one inner tray, the edge of the tray defined by an intersection between the at least one article-supporting wall member and the plurality of planar sidewalls, towards a container-bearing surface of the at least one inner tray;

at least one energy dispersive corner disposed diagonally between two adjoining planar sidewalls, the at least one corner comprising a plurality of generally convex and concave regions having a generally sinusoidal cross-sectional shape and defining a plurality of steps leading from the edge of the at least one inner tray towards the container-bearing surface of the at least one inner tray.

12. The package of claim 11, wherein the outer container comprises at least three lateral side panels and two end panels.

13. The package of claim 11, wherein the outer container comprises a corrugated cardboard material.

14. The package of claim 11, wherein the at least one sidewall has a substantially uniform wall thickness.

15. The package of claim 11, wherein each of the generally convex and concave regions of the at least one sidewall has an average radius of curvature greater than about 2.54 millimeters (about 0.1 inch).

16. The package of claim 11, wherein the at least one inner tray comprises a generally rectangular tray, and wherein the at least one sidewall comprises at least four sidewalls, each of the at least four sidewalls disposed proximate a respective corner of the generally rectangular tray.

17. The package of claim 16, wherein each of the at least four sidewalls has a generally partial conical shape.

18. The package of claim 11, wherein at least a portion of the at least one article-supporting wall member is generally planar.

19. The package of claim 11, wherein the at least one sidewall extends from the edge of the at least one inner tray towards a container-bearing surface on a generally planar container-bearing flange of the at least one inner tray.

20. The tray of claim 18, wherein at least another portion of the at least one article-supporting wall member defines a container-bearing structure, at least a portion of the container-bearing structure being substantially coplanar with the generally planar container-bearing flange of the at least one inner tray.

21. The package of claim 20, wherein the container-bearing structure comprises a dimple substantially surrounded by the at least a portion of the container-bearing structure.

22. The package of claim 11, wherein the at least one inner tray comprises a substantially non-porous polymer material.

23. The package of claim 11, wherein the at least one inner tray comprises a first inner tray and a second inner tray.

24. The package of claim 23, wherein the first inner tray and the second inner tray are configured to carry at least one bottle.

25. A method of packaging an article of manufacture, the method comprising:

providing a tray comprising at least one planar sidewall extending from an edge of the tray, the edge of the tray defined by an intersection between at least one article-supporting wall member and the at least one sidewall, towards a container-bearing surface of the tray, and comprising at least one energy dispersive corner disposed diagonally between two adjoining planar sidewalls, the at least one corner comprising a plurality of generally convex and concave regions having a generally sinusoidal cross-sectional shape and defining a plurality of steps leading from the edge of the tray towards a container-bearing surface of the tray;

inserting the tray into an outer container and causing the container-bearing surface of the tray to abut against a corner or edge of the outer container;

inserting at least a portion of an article of manufacture into at least one recess defined by at least a portion of the article-supporting wall member of the tray;

providing an additional tray comprising at least one planar sidewall extending from an edge of the additional tray, the edge of the tray defined by an intersection between at least one article-supporting wall member and the at least one sidewall, towards a container-bearing surface of the additional tray and comprising at least one energy dispersive corner disposed diagonally between two adjoining planar sidewalls, the at least one corner comprising a plurality of generally curved regions having a generally sinusoidal cross-sectional shape and defining a plurality of steps leading from the edge of the additional tray towards a container-bearing surface of the additional tray; and inserting at least another portion of the article of manufacture into at least one recess defined by at least a portion of the article-supporting wall member of the additional tray.

26. The method of claim 25, wherein inserting the at least a portion of the article of manufacture into the at least one recess comprises inserting at least a portion of a bottle into the at least one recess.

* * * * *